US007112094B2

(12) United States Patent
Reilly et al.

(10) Patent No.: US 7,112,094 B2
(45) Date of Patent: Sep. 26, 2006

(54) METHOD FOR SECURING A FLEXIBLE CABLE SHEATH TO AN ELECTRICAL ADAPTER SHELL

(75) Inventors: Joseph M. Reilly, Wichita, KS (US); Nicholas H. Neely, Alpharetta, GA (US)

(73) Assignee: M-Pyre, L.L.C., Wichita, KS (US)

( * ) Notice: Subject to any disclaimer, the term of this patent is extended or adjusted under 35 U.S.C. 154(b) by 0 days.

(21) Appl. No.: 10/375,859

(22) Filed: Feb. 27, 2003

(65) Prior Publication Data

US 2004/0171306 A1 Sep. 2, 2004

(51) Int. Cl.
*H01R 9/03* (2006.01)

(52) U.S. Cl. ..... 439/610

(58) Field of Classification Search ..... 439/932, 439/730, 98, 610, 579, 464, 470, 998, 578; 174/87, 84 R, 74 A; 138/155, 178, 156; 428/913, 77, 99

See application file for complete search history.

(56) References Cited

U.S. PATENT DOCUMENTS 3,379,218 A * 4/1968 Conde ..... 174/DIG. 11
3,770,556 A * 11/1973 Evans et al. ..... 428/77
3,899,807 A * 8/1975 Sovish et al. ..... 138/156
4,237,174 A * 12/1980 Lagardere et al. ..... 174/DIG. 8
4,465,717 A * 8/1984 Crofts et al. ..... 428/41.9
5,028,742 A * 7/1991 Redman ..... 174/88 R
5,278,356 A * 1/1994 Miller ..... 174/117 A
5,360,584 A * 11/1994 Hansen et al. ..... 264/470
5,755,597 A * 5/1998 Panis et al. ..... 439/610
5,763,820 A * 6/1998 Philpot et al. ..... 102/531
5,911,595 A * 6/1999 Orr et al. ..... 439/471
6,164,987 A * 12/2000 Mirabella et al. ..... 439/610

* cited by examiner

*Primary Examiner*—Briggitte R. Hammond
(74) *Attorney, Agent, or Firm*—Kenneth H. Jack; Davis & Jack, L.L.C.

(57) ABSTRACT

A method for securing a flexible cable to an electrical adapter shell, the electrical adapter shell having a nipple having an outwardly opening channel, the method including the steps of extending the cable sheath over the nipple, providing a thermoplastic strap, compressing the thermoplastic strap's inner end and the flexible cable sheath into the nipple's outwardly opening channel, wrapping the thermoplastic strap about the flexible cable sheath, adhesively attaching the thermoplastic strap's outer end to the thermoplastic strap's immediately underlying wrap, and nestingly compressing and heat shrinking the spirally wrapped thermoplastic strap about the flexible cable sheath and into the nipple's outwardly opening channel.

5 Claims, 3 Drawing Sheets

METHOD FOR SECURING A FLEXIBLE CABLE SHEATH TO AN ELECTRICAL ADAPTER SHELL

FIELD OF THE INVENTION

This invention relates to electrical connection or coupling devices or assemblies comprising electric cables, a protective flexible sheathing or tubular armoring sleeve, and a cable terminating adapter shell.

BACKGROUND OF THE INVENTION

Constant force spring electrical connection adapter assemblies are known. Such assemblies typically comprise a hollow bored cable terminating adapter shell comprising a body portion having forward and rearward ends, the forward end of the body portion being adapted for removable attachment to an electrical component housing or to an electric junction box, and the rearward end of the body portion being adapted for removable attachment to a protective cable sheathing. The forward adaptation typically comprises a helically threaded rotatable coupling nut or an outwardly extending mounting flange having mounting screw receiving apertures. The rearward adaptation of such hollow bored adapter typically comprises a cylindrical nipple having a circular cross sectional shape and having an outwardly opening constant force spring receiving channel.

In use of such constant force spring adapter, the nipple is nestingly extended into the forward opening of a flexible cable sheathing so that the sheathing overlies the nipple's outwardly opening channel. Thereafter, a constant force spring (also known as a negator or Hunter spring) is spirally wrapped about the nipple and about the sheathing to flexibly compress the sheathing radially inward into the outwardly opening channel. The inward compression securely annularly attaches the sheathing to the nipple. A drawback or deficiency of such constant force spring adapter and sheathing assemblies is that the cross sectional shape of the nipple is restricted to circular. Where the nipple has, for example, a non-circular oval shape, a circular constant force spring wrapped thereabout will undesirably drive the sheathing into the outwardly opening channel only at a pair of contact points, resulting in an insecure sheath attachment.

Shrink ring adapter assemblies are configured similarly with constant force spring adapter assemblies, as described above. As in constant force spring adapters, the forward end of the body portion of a shrink-ring adapter comprises a coupling nut or mounting flange, and the rearward end comprises a nipple having an outwardly opening shrink-ring receiving channel. A drawback or deficiency of shrink-ring adapter assemblies relates to the dimensions of structures of the assembly which are positioned rearward of the outwardly opening shrink-ring receiving channel. Such structures typically comprise an annular ridge bordering the rearward end of the channel, and a flexible sheathing annularly overlying such ridge. In order to assemble such shrink-ring adapter, a shrink-ring must initially overlie and be slidably moveable longitudinally over the outside diameters of such rearward structures. Accordingly, the inside diameter of the shrink-ring must initially be sufficiently large to allow such slidable movement. Accordingly, a large percentage of ring shrinkage needed for such shrink-ring to effectively compress a flexible sheath into the outwardly opening channel undesirably accommodates varying outside diameters of such rearward structures. Shrinkage needed for effective sheath compression and attachment does not commence until after occurrence of shrinkage needed to accommodate obstacles to proper ring positioning. Where a circular shrink-ring is utilized for attaching a sheathing to an adapter having a non-circular nipple, such drawbacks and deficiencies are aggravated, requiring initial shrinkage to accommodate both the geometries of ridge and sheath structures and the non-circular nipple shape.

The instant inventive electrical connector assembly overcomes the drawbacks and deficiencies of both the above described constant force spring adapter assembly and shrink-ring adapter assembly by utilizing a thermoplastic strap having and being capable of plastic memory. Such strap effectively replaces the constant force spring, and the heat shrink-ring, providing mechanical benefits and advantages of both while avoiding drawbacks and deficiencies of both.

BRIEF SUMMARY OF THE INVENTION

A major structural component of the instant inventive electrical connector assembly comprises a hollow bored adapter having a forward end and a rearward end. Preferably, the forward end of the hollow bored adapter is configured to include attaching means suitable for removably connecting the adapter to an electronic component housing or electric junction box. Where the hollow bored adapter has a circular cylindrical geometry, such attaching means preferably comprises a helically threaded rotatable coupling nut, fixed helical threads, or mounting lugs or lug receiving "L" channels. Where the hollow bored adapter has a non-circular geometry such as semi-rectangular or oval, the forward end attaching means preferably comprises an outwardly extending mounting ridge or flange including screw receiving apertures, or is configured to engage mounting clips.

The rearward end of the hollow bored adapter preferably forms a rearwardly extending hollow bored nipple, the hollow bore of the nipple being continuous with the hollow bore of the adapter. Necessarily, the rearwardly extending nipple presents an outwardly opening thermoplastic strap receiving channel, such channel preferably being defined by forward and rearward annular ridges. Preferably, the annular outer surfaces of the forward and rearward annular ridges and the floor of the channel are knurled or ridged for enhanced friction upon contact with a flexible sheathing.

A second structural component of the instant inventive electrical connectir assembly comprises at least one electric cable, and preferably a bundle of electric cables extending through the hollow bore of the nipple, the cables being terminated for electrical connections at the forward opening of the hollow bored adapter.

A third structural component of the instant inventive electrical connector assembly comprises a flexible sheathing overlying the cable rearward of the nipple, and extending forwardly to overlie the outwardly opening channel of the nipple. Typically, the sheathing comprises a wire braid, but may alternately comprise polymer braid, glass fiber braid, or polymer tubing.

A fourth structural component of the instant inventive assembly comprises a thermoplastic strap which is capable of alternately assuming a longitudinally stretched configuration, and a shorter plastic memory configuration. A preferred thermoplastic strap capable of assuming such stretched and memory configurations comprises polyamide plastic. The lateral dimension of such strap is dependent upon the longitudinal dimension of the channel into which such strap is intended to nestingly compress a flexible cable sheathing. Where, for example, the longitudinal dimension of the channel is one-half inch, a preferred lateral dimension of the strap is approximately three-eighths inch, leaving one-sixteenth inch at the forward and rearward ends of the channel for sheath thickness and sheath curvature. Narrower channels require utilization of a narrower strap, and wider channels require utilization of a wider strap. Where the flexible sheathing to be installed is thin and highly flexible, the width of the strap may be more closely fitted to width of the channel. A preferred thickness of the strap is 0.002 inches. The length of the strap is dictated by the circumference of the floor of the channel. Preferably, the length is sufficient to accommodate two to four spiral wraps.

In assembling the instant inventive electrical connector assembly, the forward end of a flexible sheathing is moved slidably and forwardly over protected cables and over a hollow bored nipple of a terminating adapter as described above. Such forward motion necessarily continues until the sheathing overlies the nipple's outwardly opening channel. Thereafter, an inner end of the thermoplastic strap, preferably polyimide plastic, is pressed onto the surface of the flexible sheathing, nestingly compressing such sheathing inwardly into the outwardly opening channel. Thereafter, the thermoplastic strap is wrapped about itself and about the sheathing, slightly annularly compressing the sheathing into the channel. Thereafter, an outer end of the strap is preferably adhesively attached to an immediately underlying wrap of the strap. Adhesive tape is preferably utilized for such attachment, and preferably the tape comprises a heat resistant polyimide plastic including a silicone resin adhesive.

Upon application of heat to the above described assembly, the preferred polyimide strap begins to shrink at 200° Fahrenheit, and typically reaches maximum shrinkage to its plastic memory configuration at 700° Fahrenheit. Upon assuming the plastic memory configuration, the polymer strap effectively secures and attaches the sheath to the nipple, while conforming to any non-circular geometry of the nipple. Suitably, polyester strapping may be substituted for polyimide strapping. The scope of the invention includes use of all thermoplastic strapping which is capable of alternately assuming a lengthened stretch configuration, and a shortened plastic memory configuration.

Accordingly, it is an object of the instant inventive electrical connector assembly to provide structures which overcome the drawbacks and deficiencies of constant force spring adapter assemblies and shrink-ring adapter assemblies as described above, through the use of thermoplastic strapping which operatively attaches a sheathing to an adapter's attachment nipple through a plastic memory effect.

Other and further objects, benefits, and advantages of the present invention will become known to those skilled in the art upon review of the Detailed Description which follows, and upon review of the appended drawings.

DETAILED DESCRIPTION OF A PREFERRED EMBODIMENT

Figure 1:
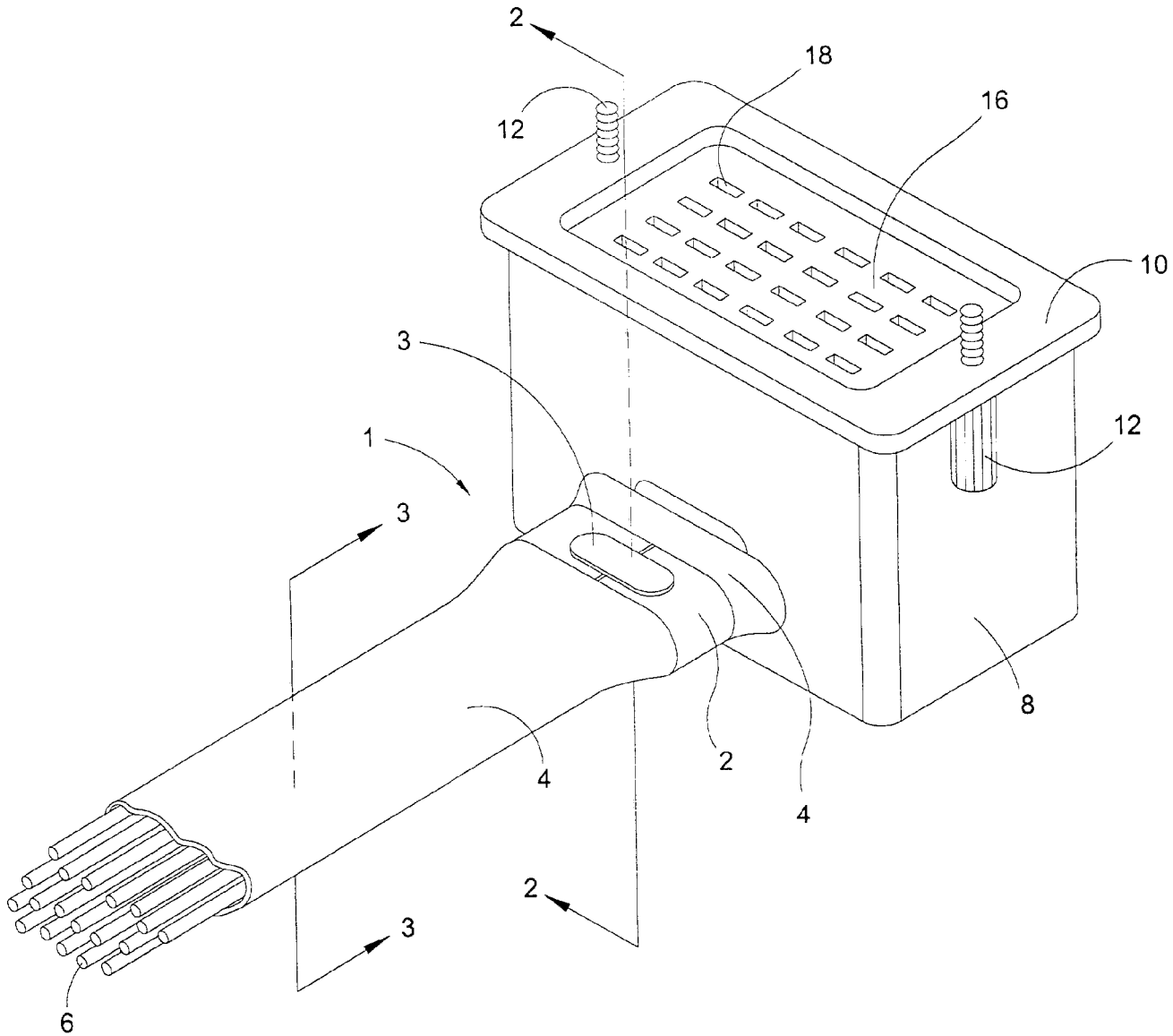
FIG. 1 is an isometric view of a preferred embodiment of the instant inventive electrical connector assembly.

Referring now to the drawings, and in particular to FIG. 1, the instant inventive electrical connector assembly is referred to generally by Reference Arrow 1. The assembly 1 preferably comprises a hollow bored adapter shell 8 having a forward opening 16 and, referring further to FIG. 3, having a rearward opening 23. The forward opening 16 is peripherally bounded by a mounting flange 10, such flange 10 supporting paired mounting screws 12; the flange 10 and screws 12 being operable to fixedly and removably attach the adapter housing 8 to an electric terminal of an electrical component housing or junction box (not depicted).

Figure 2:
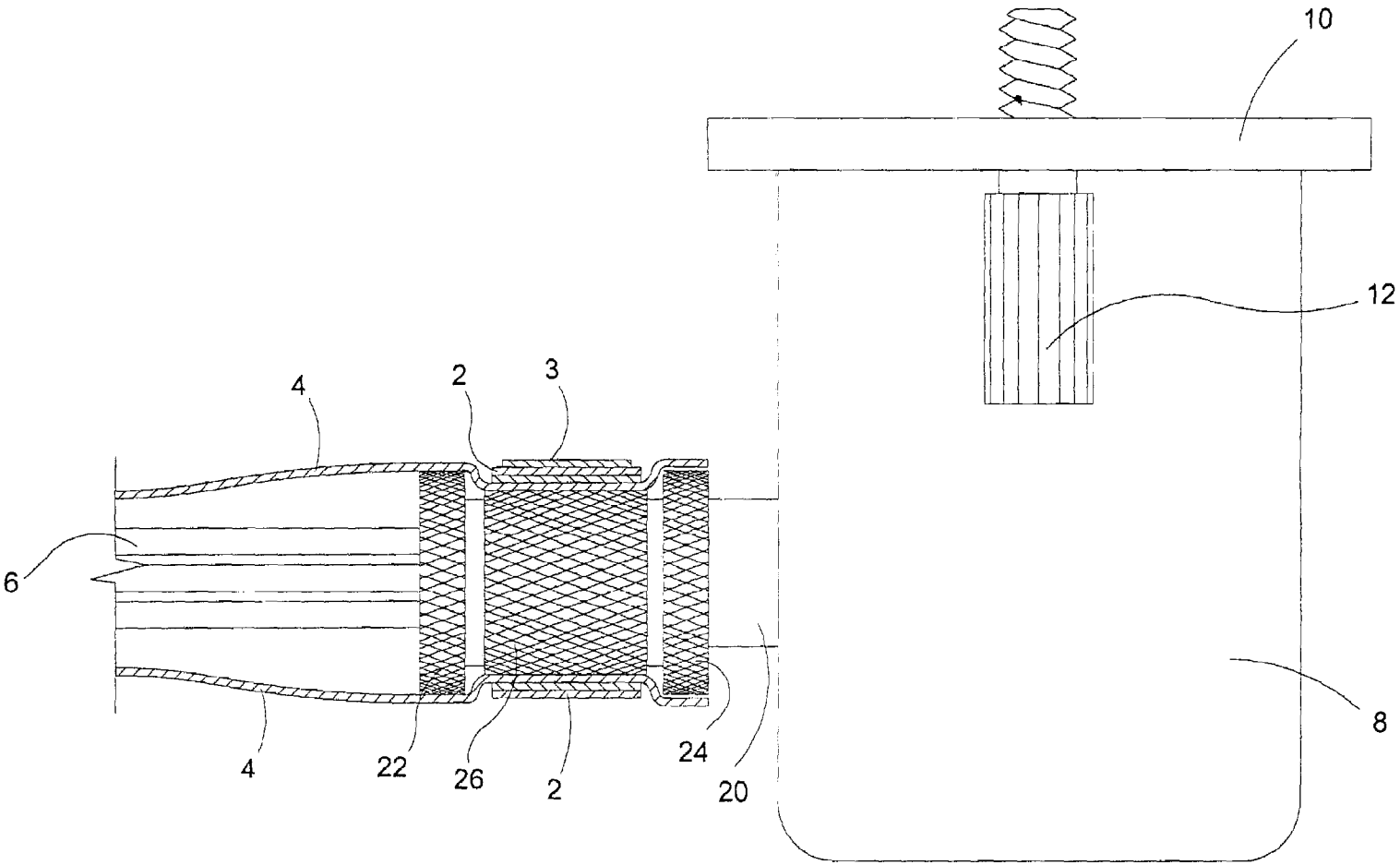
FIG. 2 is a sectional view as indicated in FIG. 1.
Figure 3:
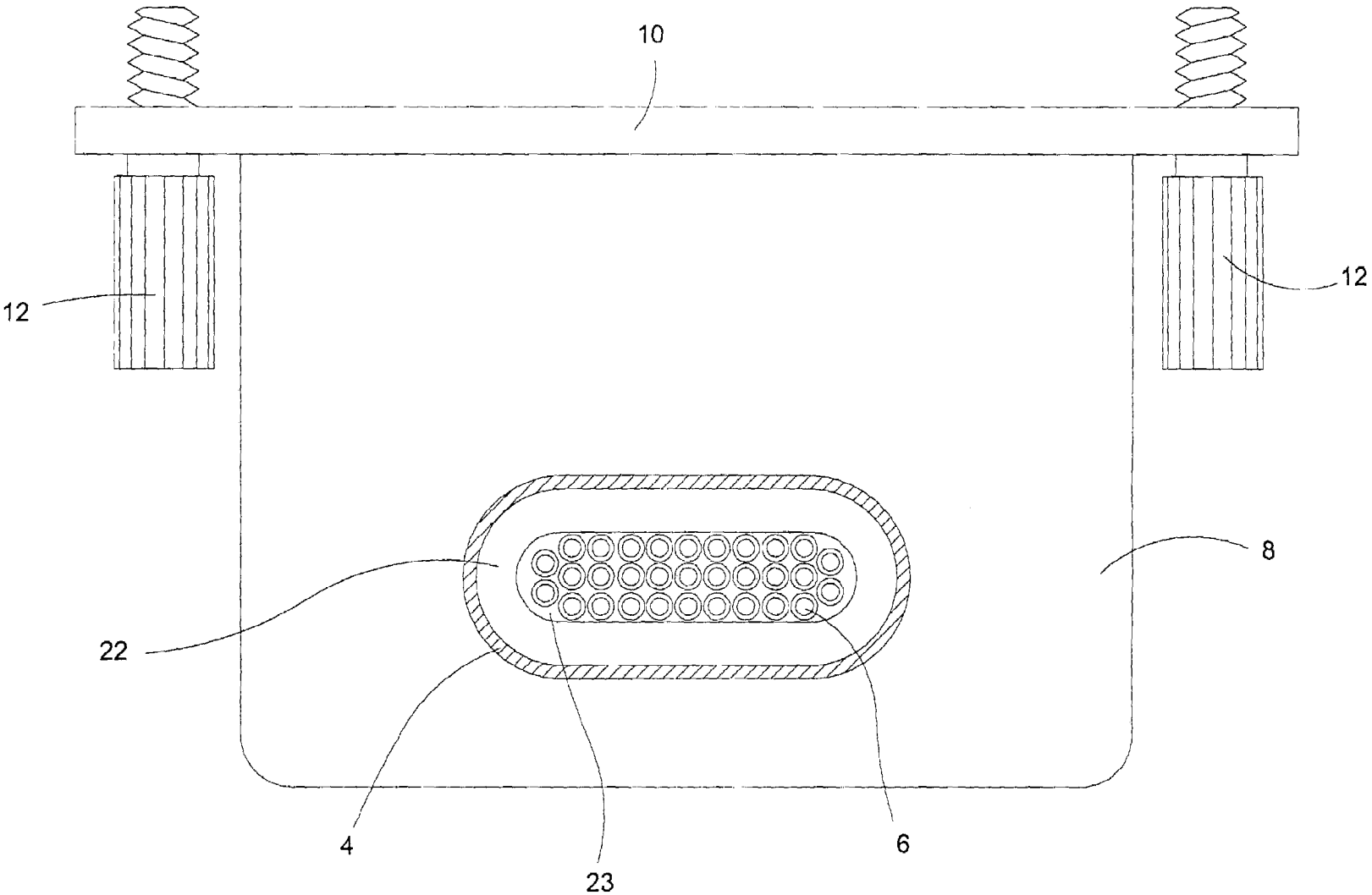
FIG. 3 is an alternate sectional view as indicated in FIG. 1.

Referring simultaneously to FIGS. 1, 2, and 3, the rearward opening 23 is bounded by an oval sheath mounting nipple 20, such nipple having rearward and forward outwardly extending ridges 22 and 24, such ridges defining an outwardly opening strap receiving channel having a knurled or ridged floor 26. Preferably, the outer surfaces of ridges 22 and 24 are similarly knurled or ridged for enhanced frictional contact.

Referring simultaneously to FIGS. 1, 2, and 3, a bundle of electric cables 6 extends through rearward opening 23, and thence through the hollow bore of adapter shell 8, such cables terminating for electrical connections at female electric slip joint terminals 18.

Referring simultaneously to FIGS. 1 and 2, a flexible protective sheathing 4 is extended over cable bundle 6 and over nipple 20 until the forward end of sheathing 4 annularly overlies the outwardly opening channel defined by ridges 22 and 24. Upon such positioning of sheath 4, a thermoplastic strap 2 which is capable of alternate stretched and shortened plastic memory configurations is spirally wrapped about sheath 4 and about nipple 20 by finger pressure, preferably slightly compressing the sheath 4 into the channel defined by ridges 22 and 24. While such spiral wrapping occurs, the thermoplastic strap necessarily is in its stretched configuration. Thereafter, the exposed outer end of strap 2 is preferably adhesively secured to the immediately underlying wrap of the strap, preferably by adhesive tape 3. Thereafter, heat is applied to the thermoplastic strap 2, inducing a geometric change in the strap to its shorter plastic memory configuration. Such geometric change in configurations causes the strap 2 and the sheath 4 to nestingly extend compressively into the channel defined by ridges 22 and 24. Such compressive nesting extension effectively secures sheath 4 to nipple 20 while accommodating the nipples non-circular shape.

While the principles of the invention have been made clear in the above illustrative embodiment, those skilled in the art may make modifications in the structure, arrangement, portions and components of the invention without departing from those principles. Accordingly, it is intended that the description and drawings be interpreted as illustrative and not in the limiting sense, and that the invention be given a scope commensurate with the appended claims.

We claim:

1. A method for securing a flexible cable sheath to an electrical adapter shell, the cable sheath having an open forward end, the electrical adapter shell having a nipple, the nipple having an outwardly opening channel, the outwardly opening channel having a width, the method comprising steps of:

(a) slidably extending the flexible cable sheath over the nipple until the flexible cable sheath overlies the nipple's outwardly opening channel;

(b) providing a heat shrinkable thermoplastic strap having an inner end, an outer end, and having a width, the width being less than the outwardly opening channel's width;

(c) nestingly compressing the heat shrinkable thermoplastic strap's inner end and the flexible cable sheath into the nipple's outwardly opening channel;

(d) extending the heat shrinkable thermoplastic strap in a plurality of spiral wraps about the flexible cable sheath;

(e) adhesively attaching the heat shrinkable thermoplastic strap's outer end to an immediately underlying wrap; and (f) further nestingly compressing the heat shrinkable thermoplastic strap and the flexible cable sheath into the nipple's outwardly opening channel, the further nestingly compressing step comprising heat shrinking the heat shrinkable thermoplastic strap.

2. The method of claim 1 wherein the heat shrinkable thermoplastic strap providing step comprises providing polyamide or polyester.

3. The method of claim 1 wherein the heat shrinkable thermoplastic strap extending step comprises two to four spiral wraps.

4. The method of claim 1 wherein the adhesively attaching step comprises steps of providing adhesive tape and adhesively taping the heat shrinkable thermoplastic strap.

5. The method of claim 4 wherein the adhesive tape providing step comprises providing heat resistant polyamide plastic in combination with silicone resin adhesive.

* * * * *